US006810695B1

(12) United States Patent
Wang

(10) Patent No.: US 6,810,695 B1
(45) Date of Patent: Nov. 2, 2004

(54) GEAR RACK ADJUSTMENT WHEEL FOR CIRCULAR KNITTING MACHINES

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 10/764,562

(22) Filed: Jan. 27, 2004

(30) Foreign Application Priority Data

Oct. 20, 2003 (TW) ..... 92218610 U

(51) Int. Cl.[7] ..... D04B 15/32
(52) U.S. Cl. ..... 66/57
(58) Field of Search ..... 66/8, 57, 78, 90, 66/104, 107, 108 R, 108 A

(56) References Cited

U.S. PATENT DOCUMENTS 3,013,418 A * 12/1961 Hill ..... 66/57
3,572,056 A * 3/1971 Radin ..... 66/57
3,614,877 A * 10/1971 Radin ..... 66/57
3,882,694 A * 5/1975 Stepanek et al. ..... 66/57
4,080,805 A * 3/1978 Ricart ..... 66/57
4,180,993 A * 1/1980 Philip ..... 66/107
4,231,234 A * 11/1980 Schmid et al. ..... 66/57
4,693,092 A * 9/1987 Plath ..... 66/55
4,798,064 A * 1/1989 Elsasser et al. ..... 66/57

* cited by examiner

*Primary Examiner*—Danny Worrell
(74) *Attorney, Agent, or Firm*—Birch, Stewart, Kolasch & Birch, LLP

(57) ABSTRACT

A gear rack adjustment wheel for circular knitting machines includes a holding deck mounted on a circular knitting machine, an adjustable sliding block located at the bottom of the holding deck, a sliding trough formed in the holding deck to communicate with the adjustable sliding block, and an adjustment mechanism which includes an anchor pin and an adjustment wheel with a screw thread formed thereon. The adjustment wheel is housed in the sliding trough to be in contact with the adjustable sliding block. The adjustable sliding block has a gear rack on one side to couple with the screw thread of the adjustment wheel so by turning the adjustment wheel drives the adjustable sliding block.

5 Claims, 4 Drawing Sheets

GEAR RACK ADJUSTMENT WHEEL FOR CIRCULAR KNITTING MACHINES

This Non-provisional application claims priority under 35 U.S.C. §119(a) on Patent Application No(s). 092218610 filed in Taiwan on Oct. 20, 20003, the entire contents of which are hereby incorporated by reference.

FIELD OF THE INVENTION

The present invention relates to a gear rack adjustment wheel for circular knitting machines to adjust an adjustable sliding block to a correct position for a smooth and precise knitting operation.

BACKGROUND OF THE INVENTION

Referring to FIG. 1, a conventional cam fine-tuning apparatus includes a straddle dock 11, a sliding block 12 coupled on the straddle dock 11 that has a plurality of cams 16 fastened thereon, a fine-tuning assembly 13 located on the straddle dock 11 that has a screw thread, a retaining member 14 located respectively on an upper edge and a lower edge of the straddle dock 11, and a spring 15 located between the retaining member 14 at the lower edge of the straddle dock 11 and the sliding block 12.

The fine-tuning assembly 13 has a first sloped surface 131 extending into a trough 121 of the sliding block 12 to be in contact with a second sloped surface 1211 formed on the trough 121. When the fine-tuning assembly 13 is turned, it is moved outwards from the straddle dock 11 along the screw thread. The fine-tuning assembly 13 presses the sliding block 12, with the first sloped surface 131 ramming the second sloped surface 1211 so that the sliding block 12 is pushed downwards along the first sliding surface 131. By contrast, when the fine-tuning assembly 13 is turned in the reverse direction, it is moved into the straddle dock 11 along the screw thread, and the spring 15 located between the retaining member 14 at the lower edge of the straddle dock 11 and the sliding block 12 will push the sliding block 12 upwards along the first sloped surface 131.

The spring 15, located between the retaining member 14 at the lower edge of the straddle dock 11 and the sliding block 12 is in a compressed state. After repeated use elastic fatigue or fatigue failure occurs, i.e. the elasticity weakens or disappears altogether. As a result, the sliding block 12 cannot return to its original position. Therefore, the circular knitting machine cannot operate properly and fails to knit correctly. Moreover, the service life of the spring 15 is limited and often requires replacement. Repairing a knitting machine is both costly and time consuming. Replacing parts not only increases overheads, while the machine is out of commission throughput is decreased.

SUMMARY OF THE INVENTION

Therefore the present invention aims at providing an improved fine-tuning mechanism that can precisely adjust the sliding block to the correct position, thus enabling the circular knitting machine to achieve a smooth and precise knitting operation.

The primary object of the invention is to solve the aforesaid disadvantages. The invention includes an adjustable sliding block which has a gear rack and an adjustment wheel containing a screw thread. The screw thread couples to the gear rack so that the adjustable sliding block can slide along the track of the adjustment wheel. Thereby the sliding block can be adjusted to the correct position to achieve a smooth and precise knitting operation.

The gear rack adjustment wheel according to the invention includes a holding deck located on a circular knitting machine, an adjustable sliding block slides along the bottom of the holding deck which has a gear rack formed on a lateral side, a sliding trough in the holding deck to communicate with the adjustable sliding block, an aperture formed on one side of the holding deck, and an adjustment mechanism which includes an adjustment wheel and an anchor pin for the adjustment wheel. The adjustment wheel is housed in the sliding trough which communicates with the adjustable sliding block so that the adjustment wheel can be in contact with the adjustable sliding block and adjust the adjustable sliding block. The adjustment wheel has a screw thread which may be coupled with the gear rack of the adjustable sliding block, a nut which has a scale to indicate the adjustment degree, and an annular ring spaced from the nut to form a gap to be wedged by the anchor pin to anchor the adjustment wheel at a desired position. The anchor pin is housed in the aperture in the holding deck.

Through the movement of the adjustment wheel, the relative position of the gear rack of the adjustable sliding block and screw track of the adjustment wheel may be altered, and the position of the adjustable sliding block may be adjusted.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 2:
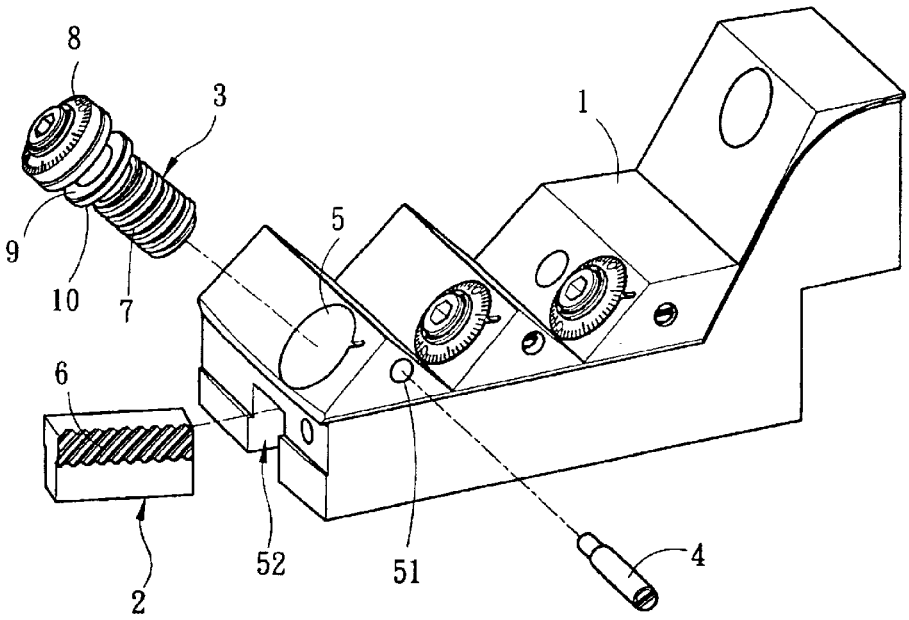
FIG. 2 is an exploded view of the present invention.

Please refer to FIG. 2, the gear rack adjustment wheel for circular knitting machines according to the invention includes a holding deck 1, an adjustable sliding block 2, slides in a sliding track 52 formed at the bottom of the holding deck 1 that has a gear rack 6 formed on a lateral side thereof, and an adjustment mechanism which includes an adjustment wheel 3 with a screw thread 7 formed thereon and an anchor pin 4 for the adjustment wheel. The holding deck 1 has a sliding trough 5 which reaches the adjustable sliding block 2 so that the adjustment wheel 3 can be in contact with the adjustable sliding block 2. The holding deck 1 further has an aperture 51 to receive an anchor pin 4 to anchor the adjustment wheel 3. The adjustment wheel 3 includes a screw thread 7 to couple with the gear rack 6, an annular ring 10 located on an extension of the screw thread 7, a nut 8 with a scale formed thereon, and a gap 9 formed between the nut 8 and the annular ring 10 to receive the anchor pin 4 which has one end exposed through the aperture 51 of the holding deck 1.

Figure 1:
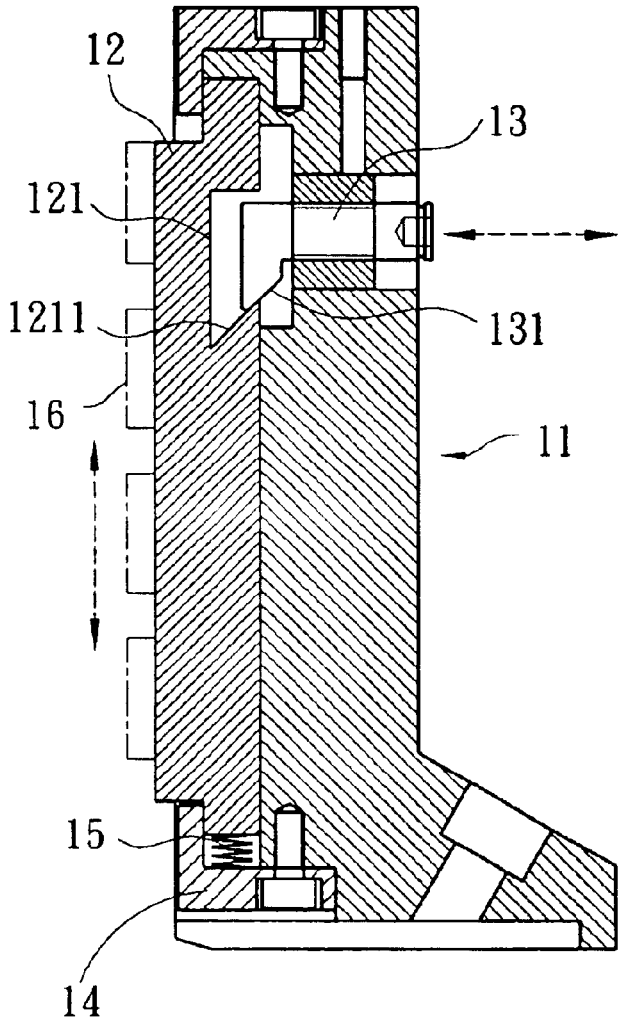
Fig.1 PRIOR ART
FIG. 1 is a schematic view of a conventional cam fine-tuning mechanism.
Figure 3:
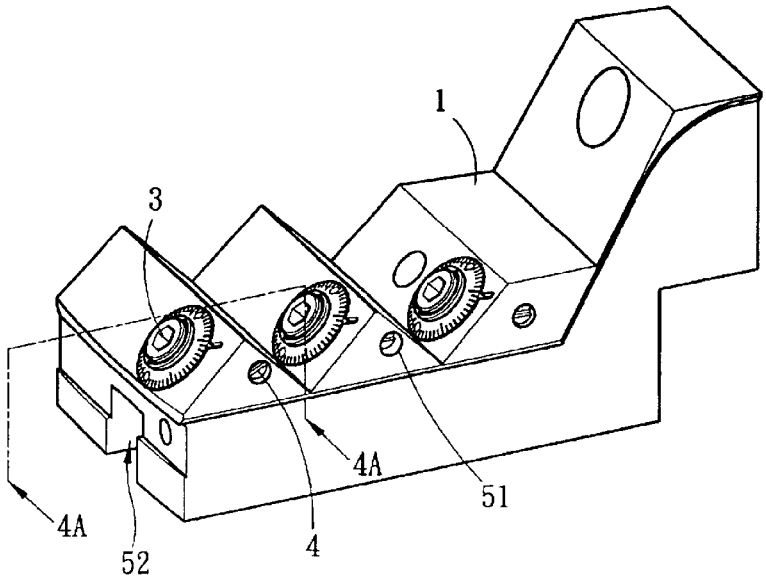
FIG. 3 is a perspective view of the present invention.

Refer to FIG. 3 for the invention mounting on a circular knitting machine. The track of the screw thread 7 corresponds to the gear rack 6. Turning the adjustment wheel 3, allows the adjustable sliding block 2 to move on the sliding track 52. The scale on the adjustment wheel 3 and the other adjustment wheels 3 allows the other adjustable sliding blocks 2 to be moved to the same position. Therefore the operation of the circular knitting machine is more smooth and precise.

Figure 4A:
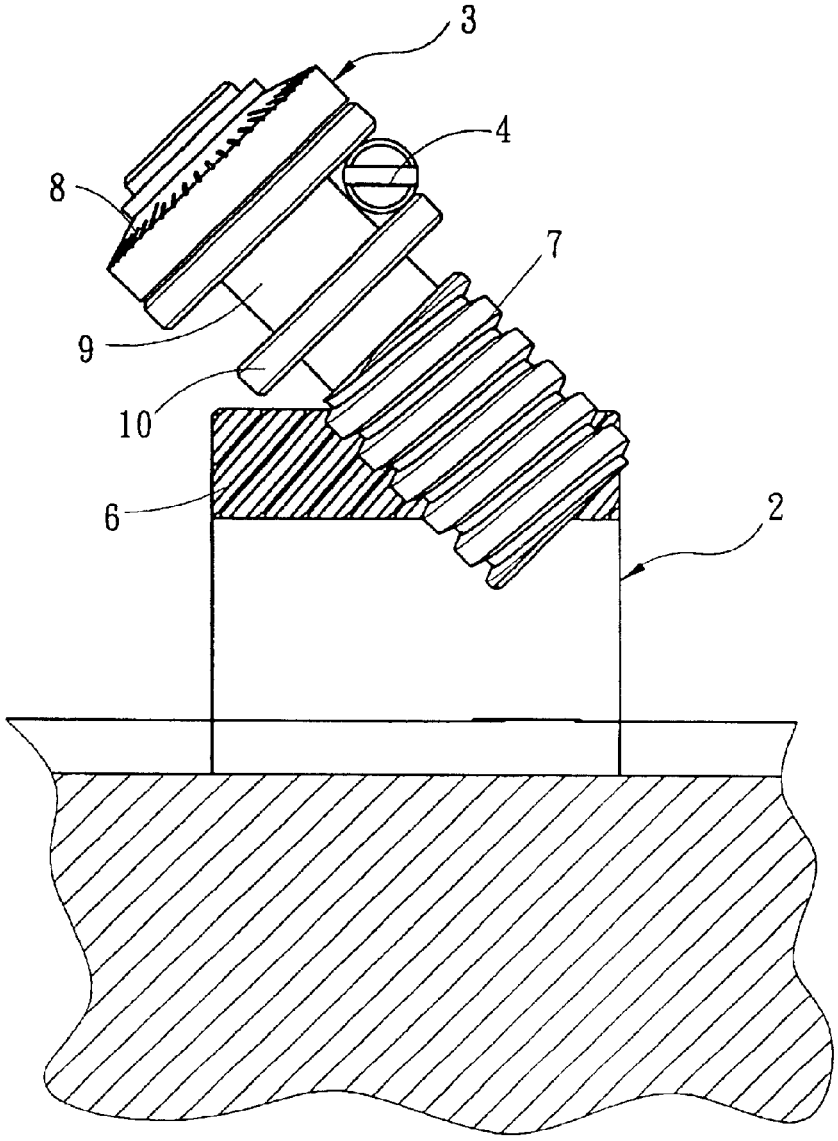
FIGS. 4A and 4B are cross sections taken on line 4A—4A in FIG. 3 showing operating condition.
Figure 4B:
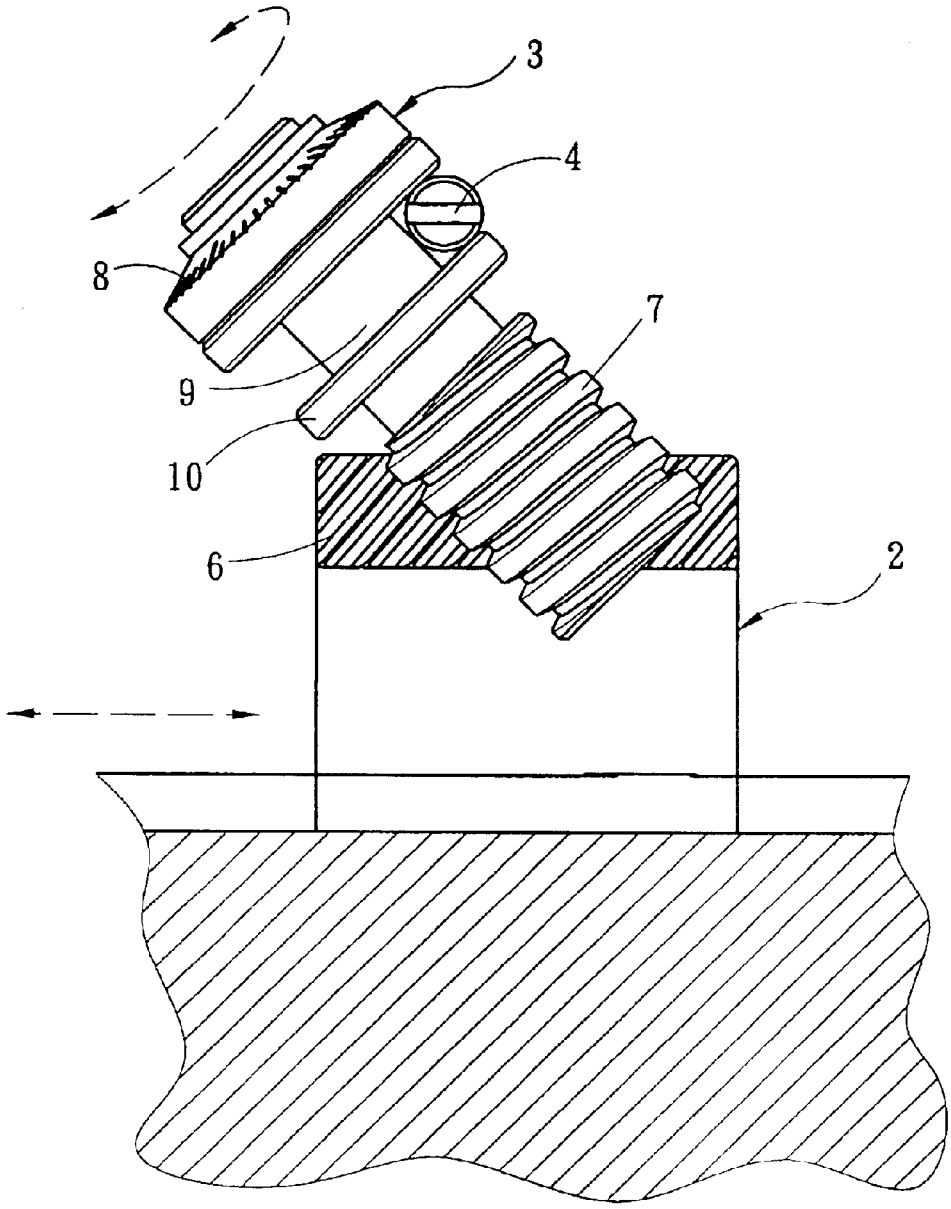

Referring to FIGS. 4A and 4B, the adjustment wheel 3 is housed in the sliding trough 5 of the holding deck 1 to couple with the gear rack 6 of the adjustable sliding block 2. The anchor pin 4 runs through the aperture 51 of the holding deck 1 to wedge in the gap 9 between the nut 8 and the annular ring 10 to anchor the adjustment wheel 3 to a selected location in the holding deck 1. When the adjustment wheel 3 is turned, the screw thread 7 also turns to drive the corresponding gear rack 6 so that the entire adjustable sliding block 2 can slide along the sliding track 52.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A gear rack adjustment wheel for circular knitting machines, comprising:

a holding deck mounted on a circular knitting machine having a sliding trough;

a sliding track formed at the bottom of said holding deck;

an adjustable sliding block to slide along the bottom of the holding deck that reaches the sliding trough, having a gear rack formed on a lateral side thereof; and an adjustment mechanism including an anchor pin and an adjustment wheel housed in the sliding trough that has a screw thread formed thereon to couple with the gear rack, a nut, an annular ring and the gap formed between the nut and the annular ring to receive the anchor pin;

wherein the adjustable sliding block is movable through the driving force of the adjustment wheel.

2. The gear rack adjustment wheel of claim 1, wherein the sliding track mates to the adjustable sliding block so that the adjustable sliding block can slide therein.

3. The gear rack adjustment wheel of claim 1, wherein the sliding trough allows the screw thread of the adjustment wheel to couple with the gear rack of the adjustable sliding block.

4. The gear rack adjustment wheel of claim 1, wherein the anchor pin runs through the gap to anchor the adjustment wheel.

5. The gear rack adjustment wheel of claim 1, wherein the anchor pin is a cylindrical strut.

* * * * *